US011248861B2

(12) United States Patent
Lukic

(10) Patent No.: US 11,248,861 B2
(45) Date of Patent: Feb. 15, 2022

(54) FIREARM ASSEMBLY, RECEIVER AND METHOD

(71) Applicant: Southern Cross Small Arms Pty Ltd, New South Wales (AU)

(72) Inventor: Damir Lukic, New South Wales (AU)

(73) Assignee: Southern Cross Small Arms Pty Ltd, New South Wales (AU)

( * ) Notice: Subject to any disclaimer, the term of this patent is extended or adjusted under 35 U.S.C. 154(b) by 0 days.

(21) Appl. No.: 16/968,129

(22) PCT Filed: Feb. 13, 2019

(86) PCT No.: PCT/AU2019/050110
§ 371 (c)(1),
(2) Date: Aug. 6, 2020

(87) PCT Pub. No.: WO2019/157555
PCT Pub. Date: Aug. 22, 2019

(65) Prior Publication Data

US 2021/0010768 A1 Jan. 14, 2021

(30) Foreign Application Priority Data

Feb. 13, 2018 (AU) ..... 2018900442

(51) Int. Cl.
*F41A 3/66* (2006.01)
*F41A 21/48* (2006.01)

(52) U.S. Cl.
CPC ..... *F41A 3/66* (2013.01); *F41A 21/485* (2013.01)

(58) Field of Classification Search
CPC ..... F41A 3/66; F41A 21/485
USPC ..... 42/75.01, 75.02, 75.03, 75.04
See application file for complete search history.

(56) References Cited

U.S. PATENT DOCUMENTS 2,205,857 A * 6/1940 Marchand ..... F41A 21/487 42/75.01
3,206,885 A * 9/1965 Garnett ..... F41C 23/00 42/75.03
3,830,003 A * 8/1974 Clerke ..... F41C 23/00 42/75.03

(Continued)

FOREIGN PATENT DOCUMENTS

WO 2016086191 A2 6/2016

OTHER PUBLICATIONS

International Search Report issued in PCT/AU2019/050110; dated May 17, 2019.
Written Opinion issued in PCT/AU2019/050110; dated May 17, 2019.

*Primary Examiner* — Joshua E Freeman
(74) *Attorney, Agent, or Firm* — Studebaker & Brackett PC

(57) ABSTRACT

In one aspect the invention provides a firearm assembly comprising a barrel, receiver and stock, wherein the assembly comprises a first fastener operable to fasten a first section of the receiver so as to locate the receiver in the stock and so as to align the receiver with the stock, wherein the assembly further comprises a second fastener operable to fix a second section of the receiver in place relative to the stock and wherein the second fastener is adjustable to fix the second section of the receiver in place without applying stress to the receiver. Embodiments of this invention may allow fixing a second section in place relative to the stock which place the second section of the receiver assumes naturally when the first part of the receiver is located and aligned by the first fastener.

15 Claims, 5 Drawing Sheets

(56) References Cited

U.S. PATENT DOCUMENTS

| | | | | |
|---|---|---|---|---|
| 4,312,146 | A | 1/1982 | Koon, Jr. | |
| 4,385,464 | A * | 5/1983 | Casull | F41C 23/00 42/75.03 |
| 6,487,805 | B1 * | 12/2002 | Reynolds | F41A 21/485 42/75.03 |
| 9,285,178 | B2 * | 3/2016 | Sellars | F41A 21/30 |
| 9,625,224 | B2 * | 4/2017 | Olsen | F41A 3/66 |
| 2010/0083551 | A1 | 4/2010 | Jamison | |
| 2012/0180360 | A1 * | 7/2012 | Jones | F41A 3/66 42/75.03 |
| 2015/0059221 | A1 * | 3/2015 | Bero | F41A 3/66 42/16 |
| 2016/0187087 | A1 * | 6/2016 | Olsen | F41A 3/66 42/75.03 |
| 2017/0314890 | A1 * | 11/2017 | Ludlow | F41A 21/48 |

* cited by examiner

FIREARM ASSEMBLY, RECEIVER AND METHOD

FIELD OF THE INVENTION

This invention relates to improvements in respect of firearm assemblies. In particular this invention relates to improvements in the mounting of firearm receivers in firearm stocks. Further in particular invention relates to improvements in the precise location and alignment of mass-manufactured firearm receivers in firearm stocks.

BACKGROUND OF THE INVENTION

Some conventional firearm assemblies have a receiver bolted directly to a stock with action screws and provision for a recoil lug that locates the receiver in the stock with recoil lug locating the receiver and transfers recoil from the receiver to the stock.

Some conventional mass manufactured receivers generally do not have perfectly true actions as may be observed in a batch of rifles. Economical manufacturing at scale and, specifically, heat treatment methods introduce a variance in how straight or true receivers in a batch might be. A common mass-manufacturing process involves machining actions to specified dimensions and then heat treating the receivers. Heat treatment in this process attempts to relieve the stresses associated with machining and impart a tougher surface finish for longevity and reliability during service. A problem with manufacturing methods involving heat treatment is that heat treatment tends to bend or warp the receivers. It may not be viable in other than high-end rifles to correct the bending of the receivers after heat treatment.

In conventional rifle assemblies a receiver is mounted with two screws, one at the front and the other at the rear of the receiver. The axial load of the recoil is absorbed by a recoil lug that acts as a stop for axial movement of the receiver along the axis of the barrel during firing. The inclusion of a recoil lug eliminates the need for mounting screws resist shear stress and a hence the mounting screws are only exposed to tensile stress by the torque required to hold the receiver to the stock.

It might be desirable in a rifle assembly to integrate commercially mass-manufactured receivers and precision CNC machined chassis systems. A problem with this approach arises from inherent bending and stressing of the commercial receiver when fitted to a CNC machined precision chassis system. If the front of the receiver is fitted and fixed to the chassis system with a screw, the recoil lug might be located manually with no positive location and pushed against the chassis until it stops with the screw tightened subsequently to a torque setting. This might result in the rear of the receiver to being off the chassis and there're may be a gap below the rear of the receiver. This gap might vary significantly from receiver to receiver with mass-manufacturing variance. Once the rear screw is torqued down the receiver might be bent and under stress. This may have detrimental effects on accuracy of the rifle.

Various solutions to this problem involve various bedding systems machined into the chassis. One solution is to machine a V block to locate a cylindrical receiver. This approach induces point loads in the receiver and does not eliminate bending or straining of the receiver.

Another solution uses an epoxy-style compound to bed the rifle action in a completely relaxed state with no induced stresses from the chassis/stock union. A limitation of this solution is that only the bedded receiver will fit in a given chassis/stock and receivers. This solution may not be suitable for mass-manufactured rifle assemblies using precision CNC machined chassis/stocks.

It would therefore be of advantage to have a rifle assembly in which a receiver is located in a stock and/or aligned with the stock which could address any or all the above problems, or at least provide the public with an alternative choice.

It would therefore be of advantage to have a receiver in which a receiver is located in a stock and/or aligned with the stock which could address any or all the above problems, or at least provide the public with an alternative choice.

DISCLOSURE OF THE INVENTION

In one aspect the invention provides a firearm assembly comprising a barrel, receiver and stock, wherein the assembly comprises a first fastener operable to fix a first section of the receiver in place relative to the stock so as to locate the first section of the receiver relative to the stock and so as to align the receiver with the stock, wherein the assembly further comprises a second fastener operable to fix a second section of the receiver in place relative to the stock and wherein the second fastener is adjustable to fix second section in a location which the second section assumes when the first section is fixed by the first fastener.

The first fastener may be operable to brace a recoil lug of the rifle assembly to transfer recoil to the stock.

The first fastener may be operable to engage a recoil lug of the rifle assembly to transfer recoil to the stock.

The first fastener may be operable to clamp the recoil lug of the rifle assembly.

The first fastener may comprise a first fastener chassis with one or more receiver-fastening bores formed therein to receive bolts assemblies to locate and align the receiver.

The one or more bores may be two or more bores.

The first fastener chassis may be integrated with the receiver.

The receiver bores of the first fastener may be operable to receive locking bolt assemblies.

The stock may comprise two or more stock bores to receive and locate the two or more bolt assemblies received in the receiver bores.

The two or more receiver bores and/or two or more stock bores may be arranged to receive respective two or more bolt assemblies arranged transverse to the receiver.

The two or more receiver-fastening bores and/or two or more stock bores may be arranged to receive respective two or more bolt assemblies arranged perpendicular to the receiver.

A bolt assembly may comprise a barrel nut and/or a barrel bolt.

Alternatively, the first fastener may be integrated with the receiver.

The receiver bores may be formed in the receiver.

Alternatively, the first fastener chassis may have a bore operable to receive a rod shaped so as to be capable of locating the receiver in the stock and aligning the receiver with the stock. The rod may have a defined cross-section. The rod may have a non-circular cross-section. The rod may have an elongate cross-section.

The second fastener chassis may have a receiver-fastening bore formed in a second fastener chassis, wherein the second bore is operable to receive a bolt assembly with some tolerance to allow adjustment in the position of the second fastener chassis so as to allow the second fastener chassis to be fixed relative to the stock without applying stress to and/or causing strain in the receiver.

The second fastener may have one or more receiver-fastening bore(s) formed in a second fastener chassis wherein the location and alignment of the receiver bore in the second fastener chassis is adjustable relative to the receiver.

The second fastener may have a receiver connection which is adjustable relative to the second receiver chassis. This may allow the second receiver chassis to be located relative to the stock and the receiver connection to be located relative to the receiver.

The second fastener may be operable to lock after adjustment.

This may allow the second fastener to be locked in a given adjusted configuration to fix the second section of the receiver without straining the receiver which is located and aligned by the first fastener.

The receiver connection of the second fastener may be adjustable rotationally about a longitudinal axis of the receiver.

The second fastener may be adjustable longitudinally with respect to the receiver.

The receiver connection of the second fastener may be operable to be locked after adjustment so as to be rigid once adjusted to fix the second section of the receiver in place relative to the stock.

In another aspect the invention provides a firearm assembly comprising a barrel, recoil lug, receiver and stock chassis, the assembly further comprising a first connector arranged to locate the receiver in the stock chassis, the assembly further comprising a second connector arranged to secure a second part of the receiver in the stock wherein the second connector is adjustable to allow for variations in the position of the second part of given receivers which are located by the first connector.

The second connector may be operable to adjust by connecting to the receiver with adjustable position in the direction of the axis of the barrel.

The second connector may be operable to adjust by connecting to the receiver with adjustable position about the axis of the barrel.

The stock may have manufactured fixtures for the second connector.

The manufactured fixtures may be in predefined positions on the stock.

The second connector may allow for variations in the position of the second part of the receiver caused by warping during heat treatment of the receivers during manufacture.

The second part of the receiver may be distal from an open end of the barrel.

The first part of the receiver may comprise a recoil lug.

The receiver may be aligned with the stock by the first connector.

The second section of the receiver may be located distal from an open end of the barrel.

The second section of the receiver may be located towards a rear end of the firearm.

The firearm may be a rifle.

In another aspect the invention provides a method of assembly of a rifle, the method comprising the steps of:

locating a forward section of a receiver in a stock and orienting the forward part of the receiver with respect to the stock;

fastening a rear section of the receiver in a location relative to the stock which is fixed;

wherein the location of the rear part of the receiver is that assumed by the receiver without strain when the forward section of the receiver is located in the stock and oriented with respect to the stock.

The step of locating the rear part of the receiver may comprise adjusting a first connector relative to a second connector so that the first connection may be located relative to the stock and the second connector may be located relative to the receiver.

In another aspect the invention provides a firearm assembly comprising a barrel, receiver stock chassis and a receiver, the assembly further comprising a first connector arranged to affix a first part of the receiver to the stock chassis while allowing a second part of the receiver which is located distal from the opening of the barrel to take a natural position relative to the stock chassis, a second connector arranged to affix a second part of the receiver to the stock chassis, wherein the second connector is able to adjustably connect to the receiver to allow for a natural position of the second part of the receiver if the receiver is warped.

In another aspect the invention provides a firearm assembly comprising a barrel, receiver and stock, wherein the assembly comprises a first fastener operable to fasten a first section of the receiver so as to locate the receiver in the stock and so as to align the receiver with the stock, wherein the assembly further comprises a second fastener operable to fasten a second section of the receiver in place relative to the stock and wherein the second fastener is adjustable to fix the second section of the receiver in place relative to the stock without applying stress to the receiver already located and aligned by the first fastener.

BRIEF DESCRIPTION OF THE DRAWINGS

Additional and further aspects of the present invention will be apparent to the reader from the following description of embodiments, given in by way of example only, with reference to the accompanying drawings in which:

FIGS. 5*a* and 5*c* give a close-up cut-away view of a rear receiver adapter according to the same embodiment as FIGS. 1 to 5*b;*

FIG. 5*c* gives a close-up cut-away view of a rear receiver adapter according to the same embodiment as FIGS. 1 to 5*b;*

Further aspects of the invention will become apparent from the following description of the invention which is given by way of example only of particular embodiments.

BEST MODES FOR CARRYING OUT THE INVENTION

Figure 1:
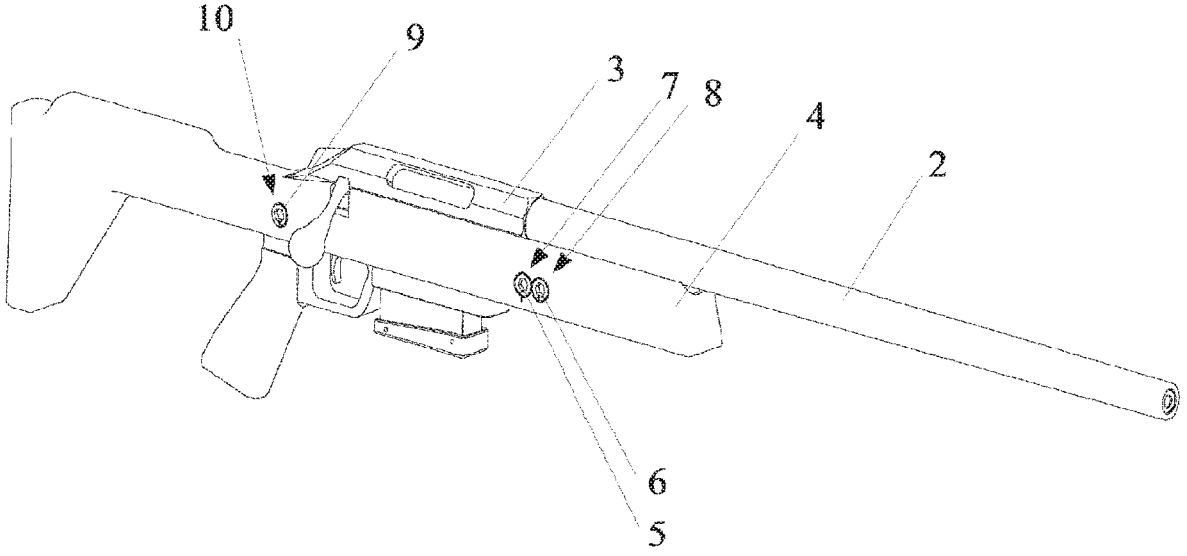
FIG. 1 gives a perspective view of a rifle assembly according to a preferred embodiment of the present invention.

FIG. 1 is a perspective view of an assembled rifle 1. The rifle 1 has a barrel 2, receiver 3 and stock 4. The barrel 2 is connected to the receiver 3 which is located by the stock 4.

Forward cross-nuts 5 and 6 are used to locate the receiver 3 in the stock 4. In the example shown two cross-nuts 5 and 6 align the receiver in the stock to align the receiver 3, and barrel 2 connected to the receiver 3, in the stock 4.

Precision bores 7 and 8 are formed in the stock 4 to receive cross-nuts 5 and 6. Similar precision bores (not shown in FIG. 1) are formed in a receiver adapter (not shown in FIG. 1) which receive the forward cross-nuts 5 and 6 to precisely locate and align the receiver 3.

A rear cross-nut 9 is received in a precision bore 10 formed in stock towards the rear. The rear cross-nut 9 is also received by a bore formed in a rear receiver adapter (not shown in FIG. 1).

Figure 2:
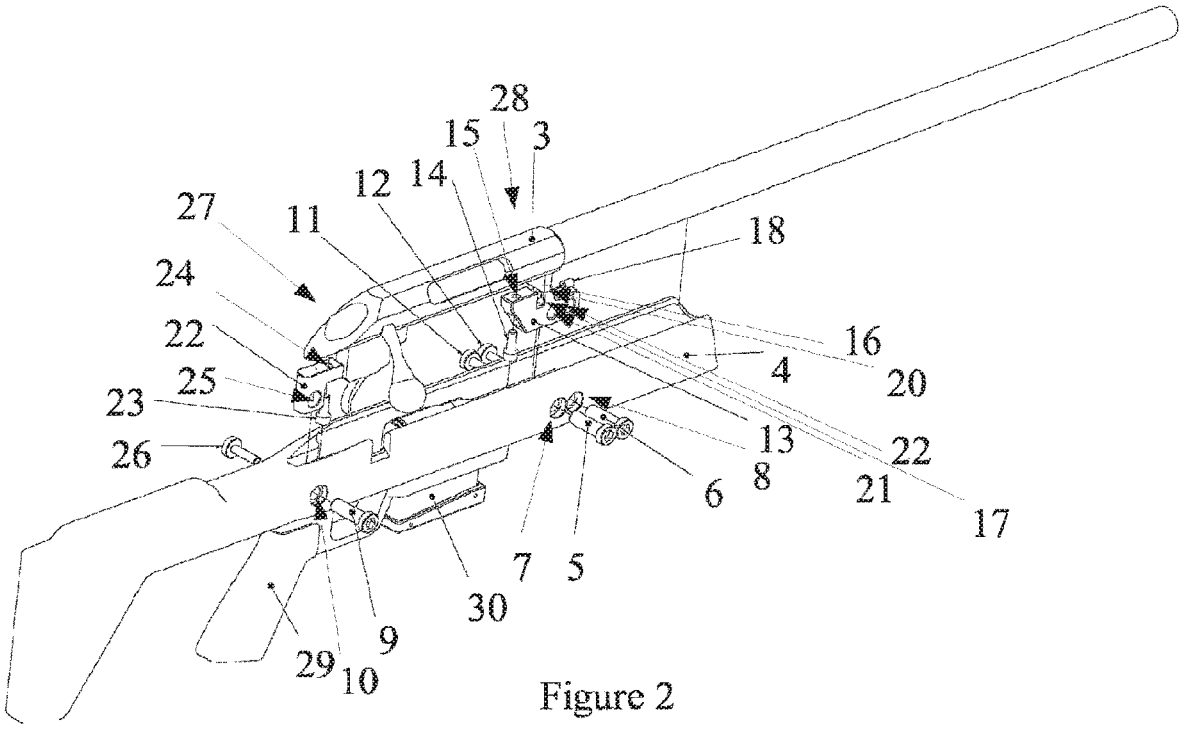
FIG. 2 gives an exploded perspective view of a rifle assembly of the same embodiment of the present invention as FIG. 1.

FIG. 2 gives an exploded perspective view of the rifle assembly 1. FIG. 2 shows the forward barrel-nuts 5 and 6 and shows cooperating forward barrel-bolts 11 and 12.

FIG. 2 shows the forward receiver adapter, or chassis, 13 which connects to the receiver 3 and which is located and aligned by the barrel-nuts 5 and 6 to locate and align the receiver 3. In this example the front receiver adapter 13 connects to a first section of the receiver 3. In this example the first section is a forward section.

As shown in FIG. 2, a forward receiver connection bolt 14 extends through a receiver-connection bore 15 to a bore (not shown) formed in the receiver 3 to connect the receiver adapter 13 to the receiver 3.

FIG. 2 also shows the forward receiver adapter 13 being able to connect to a recoil lug 16 by receiving the recoil lug 16 in a recoil slot 17 and clamping the recoil lug 16 in place with a recoil lug set screw 18 received in a clamping screw bore 20.

Forward receiver-locating, or receiver-fastening, bores 21 and 22 are formed in the receiver adapter 13. The receiver-locating bores 21 and 22 are arranged to be perpendicular to the direction of the barreled 2 and receiver 3. The receiver-locating bores 21 and 22 are precision bores dimensioned to receive forward cross-nuts 5 and 6 to precisely locate the receiver adapter 13 and connect receiver 3 in the stock 4. By the nature of two bores 21 and 22 spaced apart precise alignment of the barrel 2 and receiver 3 is achieved, with precise rotational orientation of the barrel 2 and receiver 3 relative to the stock 4. As the reader will appreciate the orientation in the example is both elevational orientation and azimuthal orientation.

In this example the receiver fastener, or adapter, 13 connects to a forward section of the receiver and connects to cross nuts 5 and 6 which extend through bores 7 and 8 to fasten the receiver 3 to the stock with fixed location and orientation to the stock. The receiver is therefore fastened to and aligned with the stock.

The rear receiver adapter 22 connects to the receiver 3 with a rear receiver-connector bolt 23 which extends through the rear connector bore 24, formed in the receiver adapter 22, and receiver connector bore (not shown) formed in the receiver 3. Specifically in this example, the rear receiver adapter 22 connects to a second section of the receiver 3. In this example the second section is a rear section 27.

The rear receiver adapter 22 has formed therein a receiver-locating, or receiver-fastening, bore 25 which is arranged, in this embodiment, perpendicular to the direction of the barrel 2 and receiver 3. The rear receiver-locating bore 25 receives the rear cross-nut 9 to allow the rear receiver adapter 22 to be clamped by tightening a rear cross-bolt 26 in the rear cross-nut 9. This clamping action fixes the receiver adapter 22 and connected receiver 3 in place relative to the stock 4. In this example, the rear receiver bore 25 is oversized compared to the diameter of the rear cross-nut 9 to allow the receiver adapter 22 and receiver 3 to be fixed in place in a position the receiver adapter 22 and receiver 3 naturally assume when the receiver 3 is located by the forward receiver adapter 13 and cross nuts 5 and 6. In this example the receiver 3 has been selected from a set of mass-manufactured receivers having a variance in how straight or true the receivers are. The set or receivers 3 will exhibit a corresponding variance in the position of the rear 27 of the receiver 3, where the receiver adapter 22 connects, when the forward part 28 of the receiver is precisely located and precisely aligned by the forward receiver bores 21 and 22 and forward cross-nuts 7 and 8. In this specific example, the receiver 3 has been selected from a set of manufactured receivers which have been machined and then subsequently heat-treated, where heat treatment may have introduced warping of the receiver 3.

The oversized bore 25 provides a tolerance around the cross-nut to allow the receiver adapter 22 to be clamped without stressing and/or straining the receiver 3 which may not be perfectly straight or true. The tolerance in the example is computed from a manufacturing tolerance of the receivers and the dimensions of the receiver 3 and adapter 22.

In this example the receiver fastener, or adapter, 22 connects to a rear section 27 of the receiver 3 and to cross nut 9 which extends through bore 10. The fastener 22 therefore fastens the rear section of the receiver 27 to the stock 4 at a location relative to the stock which the receiver section 27 assumes when the forward section of the receiver 3 is aligned with the stock by the forward receiver fastener.

FIG. 2 also shows a grip 29 and magazine 30.

Figure 3B:
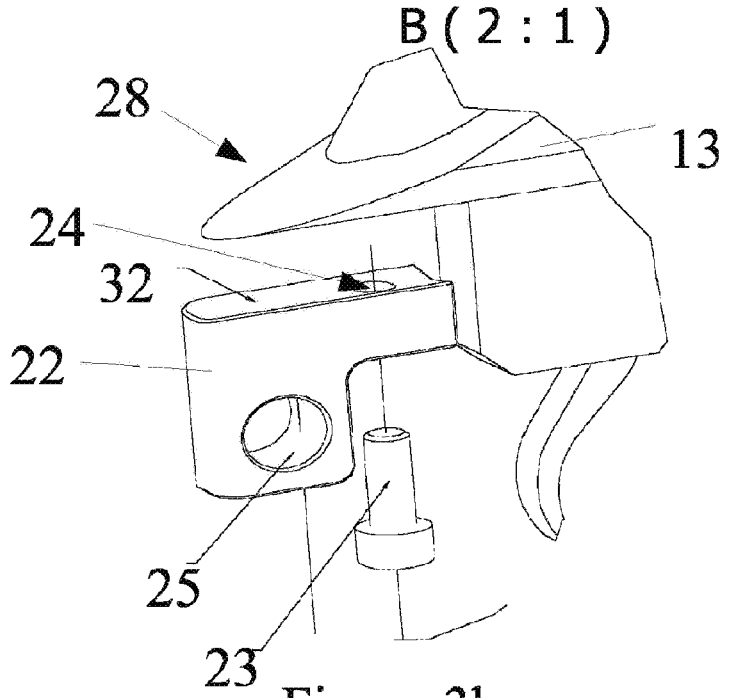
FIGS. 3*a* and 3*b* give a close-up exploded view of a forward connector of rifle assembly of the same embodiment of the present invention as FIG. 1 and FIG. 2.
Figure 3A:
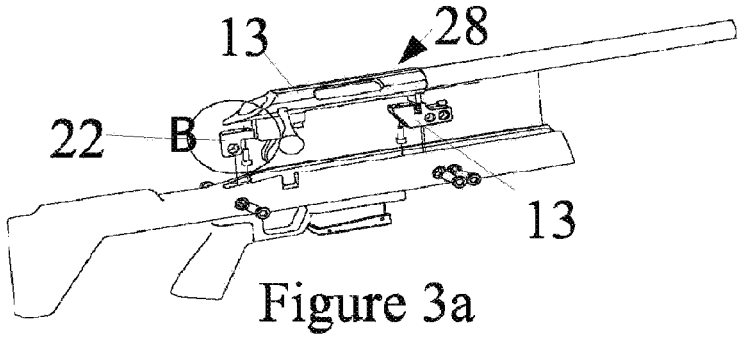

FIG. 3 gives a close-up exploded view of a forward part 28 of the receiver 3 and forward receiver adapter 13. FIG. 3 also shows the barrel 2 connected to the receiver 3 and recoil lug 16 extending, in this example, from the receiver 3. The receiver adapter 13 has formed therein a recoil lug slot 17 with a recoil bearing surface 31 against which the recoil lug 16 bears. The recoil lug set screw 18, extending through the clamping screw bore 20, clamps the recoil lug 16 in the recoil lug slot 17 and against the bearing surface 31. As shown, the forward receiver adapter 13 has a rear upper locating surface 32 which has a shape complimentary to a profile of the receiver 3 to bear against the receiver 3. Similarly, a forward upper locating surface 33 the shape complimentary to the receiver 3 bear against the receiver 3.

FIG. 3 gives a closer view of the receiver bores 21 and 22 which are precision bores formed with a tight tolerance to precisely locate the receiver adapter 13 and connected receiver 3 when the precision cross-nuts 5 and 6 extend through precision bores 7 and 8 and then precision bores 21 and 22. As the bores 7 and 8 and bores 21 and 22 are spaced apart they will precisely align the receiver 3 in addition to precisely locating it. The reader will understand that these as providing a datum for the location offer receiver 3 in stock and alignment of the barrel 2 and receiver 3 with the stock. The reader will appreciate the front receiver fastener, or adapter, 13 provide repeatability of location of the receiver in the stock and/or repeatability of orientation of the receiver with the stock 4.

Also shown in FIG. 3 is a forward receiver connection bolt 14 extending through a connection bore 15 into a bore (not shown) formed in the receiver in the 3 to connect the receiver adapter 13 to the receiver 3.

Figure 4B:
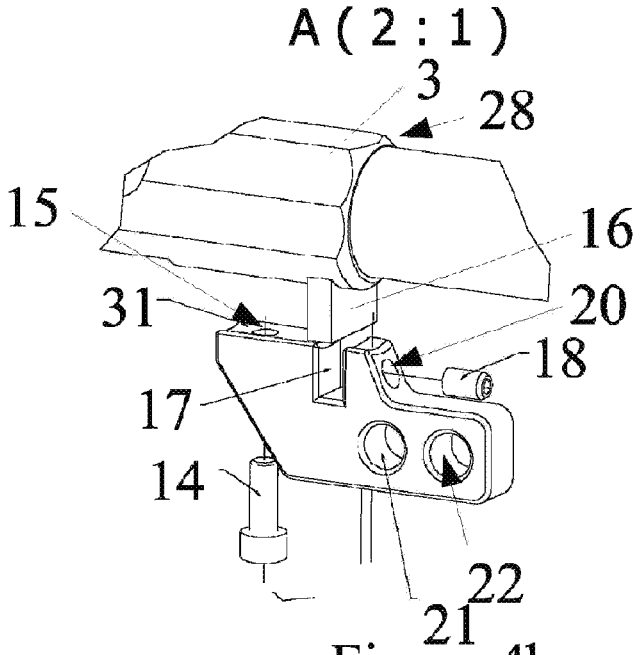
FIGS. 4*a* and 4*b* give a close-up exploded view of rear connector of a rifle assembly of the same embodiment of the present invention as FIG. 1 to FIG. 3*b;*
Figure 4A:
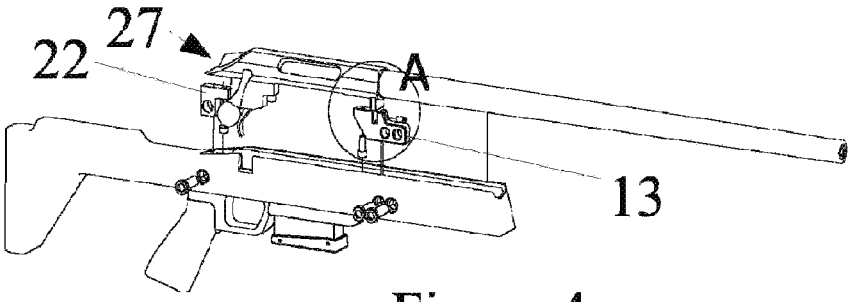

FIGS. 4*a* and 4*b* show a close-up exploded view of the rear receiver fastener, or adapter, 22 which connects to the rear part 27 of the receiver 3. The rear receiver connector bolt 23 is shown extending through the rear receiver connector bore 24. A rear receiver locating surface 34 has a profile which is complimentary to profile on the underside of the receiver 3 and bears against the receiver 3 and is fixed in contact with the receiver by the rear receiver connector bolt 23 extending through the rear receiver-connector-bore 24.

FIG. 4 shows the rear receiver-locating bore 25 which as oversized to allow the rear receiver adapter 22 to be clamped without applying stress to the receiver 3, or causing strain in the receiver 3, which might not necessarily be true or entirely straight in a mass-manufacturing scenario.

Figure 5B:
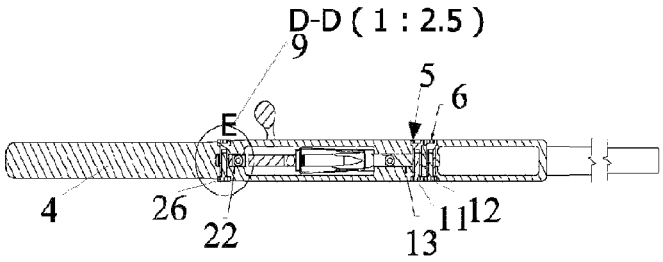
FIGS. 5*a* and 5*b* give a cut-away underside view of the rifle assembly according to the embodiment of FIGS. 1 to 4.
Figure 5C:
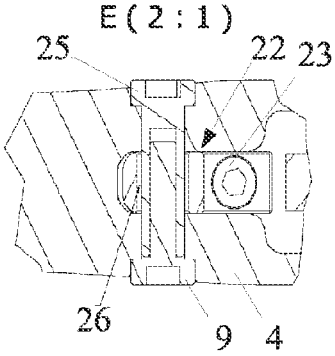
Figure 5A:
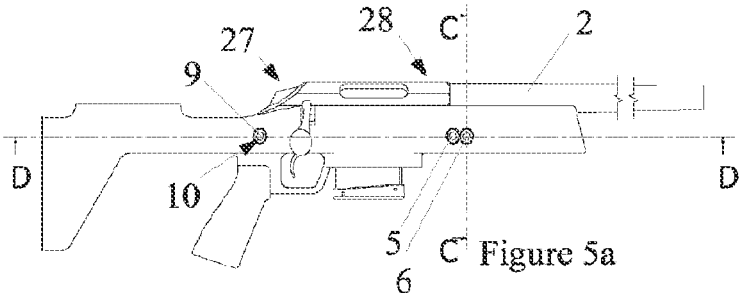
Figure 5D:
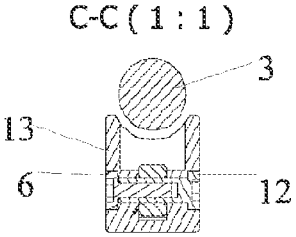
FIG. 5*d* gives a close-up cut-away elevation of the forward receiver adapter according to the same embodiment as FIGS. 1 to 5*c*.

FIG. 5*a* gives an elevation view of the rifle assembly for reference for the cut-away views given by FIGS. 5*b* to 5*d*.

FIG. 5*b* shows a horizontal cutaway view from underneath the rifle, along the line D-D of FIG. 5*a*. FIG. 5*b* shows the barrel 2, receiver 3, stock 4, forward receiver adapter 13, and cross-nuts 5 and 6. FIG. 5*b* also shows the forward receiver adapter 13 connected to the receiver 13 by forward connection bolt 14. FIG. 5*b* illustrates the forward receiver adapter being secured and located with precision to the receiver 3 and secured and located precisely with the clamping action of the nuts 5 and 6 and bolts 11 and 12.

FIG. 5*c* gives an underside cut-away view of the rear receiver adapter 22 which is connected to the receiver 3 by the rear receiver connection bolt 23. FIG. 5*c* shows the rear cross-nut 9 and rear cross-bolt 26 is to plan either in adapter 22. As illustrated in the cross-nut 9 cross-bolt 26 is a barrel nut-bolt assembly. Also shown in FIG. 5*c* is a clearance 35 provided by the rear receiver-locating bore 10 having an oversized diameter compared to the cross-nut 9. This provides a floating clearance to allow the receiver adapter 22 and receiver 3 to assume a stress-free, natural or un-strained location in the stock when precisely located and precisely aligned by the forward receiver adapter 13 but allows the rear receiver adapter 22 with cross-nut 9 and cross-bolt 10 in receiver-locating bore 10 to fix the receiver adapter 22, and thus receiver 3, in that natural location in the stock 4. The reader may recognize the rear 27 of the receiver 3 as braced to or fixed in the stock 4 in a position it assumes naturally when the receiver is located and aligned by the forward receiver adapter 13.

FIG. 5*d* gets a cutaway elevation of the rifle assembly 1 through C-C of FIG. 5*a* couple through the forward receiver adapter 13. FIG. 5*d* shows the barrel 2, receiver adapter 13, with bearing surface 32. The figure illustrates the receiver adapter 13, and thus receiver 3, being precisely located and aligned in the stock 4 by cross-nut 6, cross-bolt 12 and stock bore 8 and receiver locating bore 21.

Assembly and operation of the rifle assembly 1 will now be described to illustrate the operation of the various parts shown in FIG. 2, for example. In this specific example the assembly is performed in the steps in the order described.

The receiver 3 is provided with barrel 2 and recoil lug 16 connected. A forward receiver-adapter 13 is connected to the receiver 3 by the forward receiver connection bolt 14 extending through the receiver connector connection bore 15 and being tightened to force the bearing surface 32 against the receiver 3 to locate and fix the forward receiver adapter 13 to the receiver 3. The forward receiver adapter 13 is also clamped to the recoil lug 16 by receiving recoil lug 16 in recoil lug slot 17 and tightening the recoil lug set screw 18. The forward receiver adapter is now mechanically coupled to the receiver and can be located in stock 4 to locate the receiver 3 in the stock 4. The forward receiver adapter 13 can also be oriented to orient the receiver 3 to align it with the stock 4, for example.

The rear receiver adapter 22 is connected to the rear 27 of the receiver 3 with rear receiver connector bolt 23 through rear receiver connector bore 24 to force the bearing surface 34 against the underside of the receiver 3. This fixes the rear receiver adapter 22 to the receiver 3 and allows it to be used to fix the rear part 27 of the receiver 3 in place relative to the stock or to brace the receiver against the stock in a given position. In this embodiment the position or the rear part 27 of the receiver 3 relative to the stock 4 is a position it assumes after the forward part is aligned with the stock 4 and fixed in place using the forward receiver adapter 22. The position of a rear part 27 of a given receiver will depend on the given warping, for example, that occurred in the given receiver during heat treatment, for example, during manufacture.

The receiver 3 is located in the stock by having precision forward receiver locating bores 21 and 22, of tight tolerance, aligned with forward stock precision bores 7 and 8 and by the bores receiving forward cross-nuts 5 and 6 receiving forward cross-bolts 11 and 12 which are tightened in the nuts 5 and 6 to the receiver adapter 13 and to align the receiver 3 with the stock 4 and to align the barrel 2 which is connected to the receiver 3. As the receiver adapter 13 receives, and is clamped to, the recoil lug 16, the receiver adapter 13 is able to transfer recoil from the recoil lug 16 to front receiver adapter 13, to the cross nuts 5 and 6 and to the stock 4.

The rear receiver-locating bore 25 is approximately aligned with the rear stock locating precision bore 10, the rear cross-nut 9 is received through the bores and the rear cross-bolt 26 is received by the rear cross-bolt 9.

In this specific example the receiver 3 has been formed by machining and subsequent heat treating and the heat treating has introduced a manufacturing tolerance or variance to the straightness or trueness of the receiver 3. The rear receiver bore 25 is oversized compared to the rear cross-nut 9 and accommodates a tolerance in the straightness or trueness of the receiver three by allowing the rear 27 of the receiver 3 to assume a natural, non-strained and non-stressed location within the stock when the forward receiver adapter 13 is located in place in the stock. The cross-bolt 26 can then be tightened on the cross-nut 9 to clamp rear receiver adapter 22 to fix it in place to fix in place the rear 27 of the receiver 23 while accommodating the manufacturing tolerance and the straightness or trueness of the receiver 3.

A method of assembly of a rifle according to an embodiment of the invention will now be described.

A receiver 3 assembled with barrel 2 and recoil lug 16 are connected to forward fastener 13 by bolt 14 through bore 15 in the fastener 13. The recoil lug 16 is received by recess 17 and clamped in place by a grub screw 18.

The forward section of the receiver is then fastened to the stock 4 by bolt assemblies 5 and 11 and 6 and 12 extending through bores 7 and 8. This step locates the forward section of the receiver 3 relative to the stock 4 and aligns the receiver with the stock 4 while a rear section 27 of the receiver is allowed to assume a natural location relative to the stock. This location will vary with variations in how true the receiver is after manufacturing steps such as heat treating, for example.

The rear receiver fastener 22 is connected to the rear receiver section 27 by bolt 23 through bore 24.

Next rear receiver section 27 is fixed in place relative to the stock 4 with the section 27 at a location is assumed when the receiver is located and aligned by the forward fastener 13. This step involves the bolt assembly 9 and 26 is passed through bore 10 in the stock and bore 25 in the fastener 22. The bore 25 is oversize compared to the bolt assembly 9 and 26 to allow variation in the position of the fastener 22 due to variations in shape of the receiver. The fastener 22 is then clamped by bolt assembly 9 and 26.

Further and additional embodiments will now be described.

In alternative embodiments pairs of cross-nuts and bores, such indicated by 5 and 6, 7 and 8 and 21 and 22 may be substituted with rods and apertures with a cross-section capable of both locating the receiver adapter in the stock and aligning the receiver adapter with the stock. In these embodiments any suitable shape known to the skilled reader may be used including but not limited to elliptical cross sections, square cross sections triangular cross sections, and particularly any elongate cross sections.

In some further and additional embodiments two sets of bores, bolts and barrel nuts are substituted with a single set of bore, bolt and nut of a cross-sectional shape suitable as known to the reader to orient the receiver with respect to the stock. In some of these embodiments the shape is a non-round shape as known to the reader as suitable.

In alternative embodiments the rear receiver adapter 22 may connect to the rear 27 of the receiver 3 in an adjustable location along the receiver, such as forward and backwards relative to the receiver and barrel. In one embodiment the rear receiver connection bore 24 is replaced with a rear receiver connection slot with the slot aligned with an axis of the receiver 3 and barrel 2. In another embodiment the receiver connection bore 24 is oversized. In alternative embodiments the rear receiver adapter may connect to the rear 27 of the receiver 3 within the adjustable rotational position about an axis of the receiver 3 and barrel 2. In one embodiment the receiver connection bore 24 might be a slot which is arcuate and perpendicular to an axis of the receiver 23 and barrel 2. In some embodiments a slot that is aligned with the axis of the receiver 3 or alternatively perpendicular to the axis of the receiver may be oversized relative to the rear receiver connection bolt 24.

Embodiments of the invention provide a method of assembling a rifle. In various alternative embodiments the rifle is assembled in any combination or permutation of the steps described herein.

Embodiments of the present invention integrate commercially-available receivers and new designs of receivers, with a mounting which is perpendicular to the bore axis by using receiver adapters or having the new mounting provision machined into the receiver base. In some embodiments adapters are mounted to the commercially available receiver independent of each other using original Equipment Manufacturer (OEM) toque specifications to limit any stresses induced into the receiver itself. In some embodiments a front adapter also comprises a recoil lug clamp having a set screw to secure the adapter with full compliance against the receiver, eliminating any movement or deviation that can affect accuracy of the rifle in service. In some embodiments two precision cross-bolts are used to locate the front adapter (or receiver locating holes) precisely to the chassis/stock. In some embodiments this locates the receiver precisely and provides axial compliance such that it prevents the rotation of the receiver assembly about the perpendicular axis to the rifle bore axis and recoil resistant fixing point. Due to the precise nature of the cross-bolt assembly, the repeatability of location and alignment of a receiving is perfect to a high tolerance. In some embodiments a return to ZERO position can be achieved with no deviation from the position during disassembly for maintenance.

Embodiments of this invention may allow fixing a second section in place relative to the stock which place the second section of the receiver assumes naturally when the first part of the receiver is located and aligned by the first fastener.

Embodiments of this invention may allow a receiver that has a shape which deviates from straight to be located and aligned precisely at a first section and fixed in place at a second section.

Embodiments of this invention may allow a receiver that has been selected from a set of mass manufactured receivers with a given variance in shape and/or dimension to be located and aligned precisely at a first section and braced at a second section without applying stress to and/or straining the receiver.

Embodiments of this invention may allow a receiver that has been selected from a set of receivers with a given variance in shape and/or dimension after machining and subsequent heat treatment to be located and aligned precisely at a first section and fixed in place at a second section without applying stress to and/or straining the receiver.

The bores and bolt assemblies of the examples illustrated with reference to the drawings are transverse and, specifically, perpendicular to the receiver. However, in various embodiments other examples of transverse orientations that are not perpendicular may be used.

In alternative embodiments a rear receiver adapter may locate and orient a rear section of the receiver and allow a forward section to assume a natural position. In some of these embodiments a forward receiver adapter may fix a forward section of the receiver relative to the stock.

The reader will appreciate that the bores are provided by various components by the components defining the bores.

In the preceding description and the following claims the word "comprise" or equivalent variations thereof is used in an inclusive sense to specify the presence of the stated feature or features. This term does not preclude the presence or addition of further features in various embodiments.

It is to be understood that the present invention is not limited to the embodiments described herein and further and additional embodiments within the spirit and scope of the invention will be apparent to the skilled reader from the examples illustrated with reference to the drawings. In particular, the invention may reside in any combination of features described herein or may reside in alternative embodiments or combinations of these features with known equivalents to given features. Modifications and variations of the example embodiments of the invention discussed above will be apparent to those skilled in the art and may be made without departure of the scope of the invention as defined in the appended claims.

I claim:

1. A firearm assembly comprising a barrel, receiver and stock, a first fastener operable to fix a forward section of the receiver in place relative to the stock so as to locate and align the forward section of the receiver relative to the stock, and a second fastener having a receiver adapter arranged to receive a receiver connection bolt which is operable to connect to a bore in the receiver to connect the receiver adapter to the receiver, the receiver adapter being arranged to receive the receiver connection bolt with a first tolerance to allow adjustment of the configuration of the receiver adapter by adjustment of the receiver adapter relative to the receiver and to be connected to the receiver in an adjusted configuration, the receiver adapter being also arranged to receive a bolt assembly which is operable to clamp the receiver adapter in a position relative to the stock, the receiver adapter being arranged to receive the bolt assembly with a second tolerance which allows the receiver adapter to be clamped such that said position relative to the stock is that which the receiver adapter assumes when connected to the receiver in the adjusted configuration, whereby the second fastener is configurable to brace the rear section of the receiver relative to the stock in a position the rear section of the receiver assumes when the forward section of the receiver is fixed by the first connector.

2. The firearm assembly of claim 1 comprising a recoil lug wherein the first fastener is operable to brace the recoil lug of the rifle assembly so as to transfer recoil to the stock.

3. The firearm assembly of claim 1 wherein the first fastener is operable to clamp to the recoil lug.

4. The firearm assembly of claim 1 wherein the first fastener comprises a first-fastener chassis defining one or more receiver-fastening bores formed therein to receive bolts to locate the first section of the receiver and align the receiver.

5. The firearm assembly of claim 4 wherein the one or more bores is two or more bores.

6. The firearm assembly of claim 4 wherein the first fastener chassis comprises a bore operable to receive a rod having a cross-section shaped so as to be capable of providing alignment for the receiver with the stock.

7. The firearm assembly of claim 1 wherein the stock defines one or more stock bores to receive and locate the one or more bolt assemblies received in the receiver locating bore of a fastener.

8. The firearm assembly of claim 7 wherein the one or more receiver bores and/or one or more stock bores are arranged to receive respective one or more bolt assemblies transverse to the receiver.

9. The firearm assembly of claim 1 wherein the receiver adapter of the second fastener is adjustable rotationally about a longitudinal axis of the receiver.

10. The firearm assembly of claim 1 wherein the receiver adapter of the second fastener is adjustable longitudinally with respect to the receiver.

11. The firearm assembly of claim 1 wherein the receiver adapter defines a receiver-fastening bore with tolerance to allow adjustment of the position of the receiver adapter relative to the receiver.

12. The firearm assembly of claim 11 wherein the bore is oversized for the receiver connection bolt to allow the position of the receiver adapter relative to the receiver to be adjusted before being fixed.

13. The firearm assembly of claim 11 wherein the bore is a slot aligned with an axis of the receiver to allow the position of the receiver adapter to be adjusted rotationally about the axis of the receiver before being fixed.

14. The firearm assembly of claim 11 wherein the bore is a slot perpendicular to an axis of the receiver to allow the position of the receiver adapter to be adjusted about the receiver before being fixed.

15. A method of assembly of a rifle, the method comprising the steps of:

locating a forward section of a receiver in a stock and orienting the forward part of the receiver with respect to the stock;

fastening a receiver adapter to a receiver with a receiver connection bolt received in a receiver connection bore formed in the receiver, wherein said step of fastening the receiver adapter comprises i) adjusting the configuration of the receiver adapter by adjusting it's position relative to the receiver when the receiver connection bolt is received by the fastening bore as allowed by a first tolerance provided by the receiver adapter for the receiver connection bolt, and ii) locking the receiver adapter in an adjusted configuration, and clamping the receiver adapter in a position it assumes relative to the stock when in the adjusted configuration, said clamping being performed with a bolt assembly received by the receiver adapter with a second tolerance, whereby the rear section of the receiver is braced against the stock in a position the rear section of the receiver assumes when the forward section of the receiver is fixed by the first connector, said bracing provided by the receiver adapter in the adjusted configuration.

* * * * *